US005228705A

United States Patent [19]

Merle-Smith

[11] Patent Number: 5,228,705

[45] Date of Patent: Jul. 20, 1993

[54] WINTERTIME EXERCISE DEVICE

[76] Inventor: Edmund Merle-Smith, Box 2, Keene Valley, N.Y. 12943

[21] Appl. No.: 895,220

[22] Filed: Jun. 8, 1992

Related U.S. Application Data

[63] Continuation of Ser. No. 574,818, Aug. 29, 1990, abandoned.

[51] Int. Cl.[5] ..... A63C 7/10

[52] U.S. Cl. ..... 280/11.18; 280/600; 280/604

[58] Field of Search ..... 280/604, 605, 608, 11.18, 280/11.12, 600, 601, 609, 610, 11.15

[56] References Cited

U.S. PATENT DOCUMENTS

| | | | |
|---|---|---|---|
| 40,921 | 12/1863 | Feurstein | 280/11.12 |
| 475,926 | 5/1892 | Bryant | 280/11.12 |
| 539,641 | 5/1895 | Parkhurst | 280/11.18 |
| 568,547 | 9/1896 | Reinhardt | 280/11.12 |
| 1,013,154 | 1/1912 | Greening et al. | 280/11.12 |
| 1,213,739 | 1/1917 | Buork | 280/600 |
| 1,428,676 | 9/1922 | Barlow | 280/600 |
| 1,541,019 | 6/1925 | Youngman | 280/600 |
| 2,152,011 | 3/1939 | Zier | 280/600 |
| 2,469,798 | 5/1949 | Trachslin | 280/600 |
| 3,879,474 | 4/1975 | MacDonald | 280/11.12 |
| 4,043,565 | 8/1977 | Mogannam | 280/11.12 |

FOREIGN PATENT DOCUMENTS

| | | | |
|---|---|---|---|
| 122386 | 7/1901 | Fed. Rep. of Germany | 280/600 |

OTHER PUBLICATIONS

High Peaks, "Ski Blade", Lake Placid, N.Y. 12946.

*Primary Examiner*—Margaret A. Focarino
*Assistant Examiner*—Michael Mar
*Attorney, Agent, or Firm*—Heslin & Rothenberg

[57] ABSTRACT

A wintertime exercise device has been described herein. Components of the device include: a board-like member having a top surface and a bottom surface and a runner secured to the bottom surface of the board-like member. The board-like member and runner are greater than thirty inches in length, and preferably longer than three and one-half feet. This new wintertime exercise device is used on any type of ice in a similar manner to the use of cross-country racing skis on snow. This invention provides a new sporting event to recreational users, exercisers or competitors particularly when snow or ice conditions are unfavorable for conventional wintertime activities, such as ice skating or cross-country skiing.

7 Claims, 2 Drawing Sheets

WINTERTIME EXERCISE DEVICE

This application is a continuation of application Ser. No. 574,818, filed Aug. 29, 1990, now abandoned.

BACKGROUND OF THE INVENTION

1. Technical Field

The present invention relates to exercise devices and more particularly to a novel wintertime device for gliding over smooth or rough ice and snow-patched ice.

2. Description of Prior Art

Conventionally, wintertime recreational or exercise devices for use on ice have included ice skates, such as the speed skates described in U.S. Pat. Nos. 475,926, 539,641 and 568,547, and the recreational devices described in U.S. Pat. Nos. 1,013,154 and 3,879,047.

The ice skates described in U.S. Pat. Nos. 475,926, 539,641 and 568,547 are used for racing on good quality ice. They are manufactured with longer than usual skate blades or runners, the longest of which do not appear to exceed twenty inches as described in U.S. Pat. No. 568,547.

The recreational device described in U.S. Pat. No. 3,879,047, issued to John MacDonald, on Apr. 22, 1975, has an elongated body which generally defines an elliptical plinth which approximately conforms to the dimensions of the user's foot. The body comprises a substantially flat upper surface which supports the foot of the user and a lower ice contacting surface which is configured for rocking the body about its longitudinal axis and about an axis perpendicular to its longitudinal axis for control of the ski. This type of ski is to be used on a sloping ice surface or on a flat ice surface where the participant is towed.

Another recreational device which may be used either on ice or snow is described in U.S. Pat. No. 1,013,154, issued to L. W. Greenig on Jan. 2, 1912. As with the device described in U.S. Pat. No. 3,879,047, this device is to be used on an ice covered incline. It includes a foot piece for supporting a user's foot, a runner with the end curved upward and a vertical rod fitted within the runner in order to enable the device to be used by persons of different heights without unnecessary stooping.

Another conventional wintertime activity is cross-country skiing. A participant of this activity depends upon his/her own stride and pole thrusts to move across the snow and on the snow conditions. The skier needs sufficient snow in order to be supported on the snow and the snow needs to be of a good quality, e.g. not too rough or icy. A layer of ice over snow could prove hazardous for the cross-country skier. The icy conditions could cause the skier to lose control and balance as the skier attempts to ski across the surface.

Most, if not all, of the above recreational devices do not work well on rough ice or snow-patched ice. (As used herein, snow-patched ice means patches of snow on an iced over lake. Snow-patched ice typically presents a non-uniform surface.) Applicant is not aware of a recreational device which may be used on uneven or rough ice, such as the ice typically found on frozen lakes in the wintertime. Therefore, a device which can be used on either smooth or rough ice or snow-patched ice offers significant advantages and commercial prospects. This invention in essence provides a new type of wintertime exercise activity.

SUMMARY OF THE INVENTION

A principal object of the present invention is to provide recreational users, exercisers or competitors with a new wintertime device for use on smooth or rough ice and snow-patched ice.

It is a further object of the present invention to provide a new wintertime exercise device which permits gliding over rough ice or snow-patched ice where it would ordinarily be impossible to ski or skate.

The invention described herein consists of a wintertime exercise device which may be used on ice which is smooth or, more advantageously, on rough ice or snow-patched ice. The wintertime exercise device consist primarily of an elongated board-like member and an elongated runner or blade. The board-like member has a top surface and a bottom surface and is longer than thirty inches. The runner is also longer than thirty inches and is mounted to the bottom surface of the board-like member.

As can be seen from the foregoing and the remaining portions of the specification which follow, a new wintertime sport has been created by the present invention. With this invention, recreational users, exercisers or competitors can glide across icy terrains which are smooth or rough. This advantageously permits the continuance of wintertime activities when snow and ice conditions are unfavorable for conventional wintertime activities.

BRIEF DESCRIPTION OF THE DRAWINGS

The subject matter which is regarded as the invention is particularly pointed out and distinctly claimed in the concluding portions of the specification. The invention, however, as to structure, together with further objects and advantages thereof, may best be understood by reference to the following description taken in conjunction with the accompanied drawings in which:

DETAILED DESCRIPTION OF THE INVENTION

Figures 1, 1A, 2, 3:
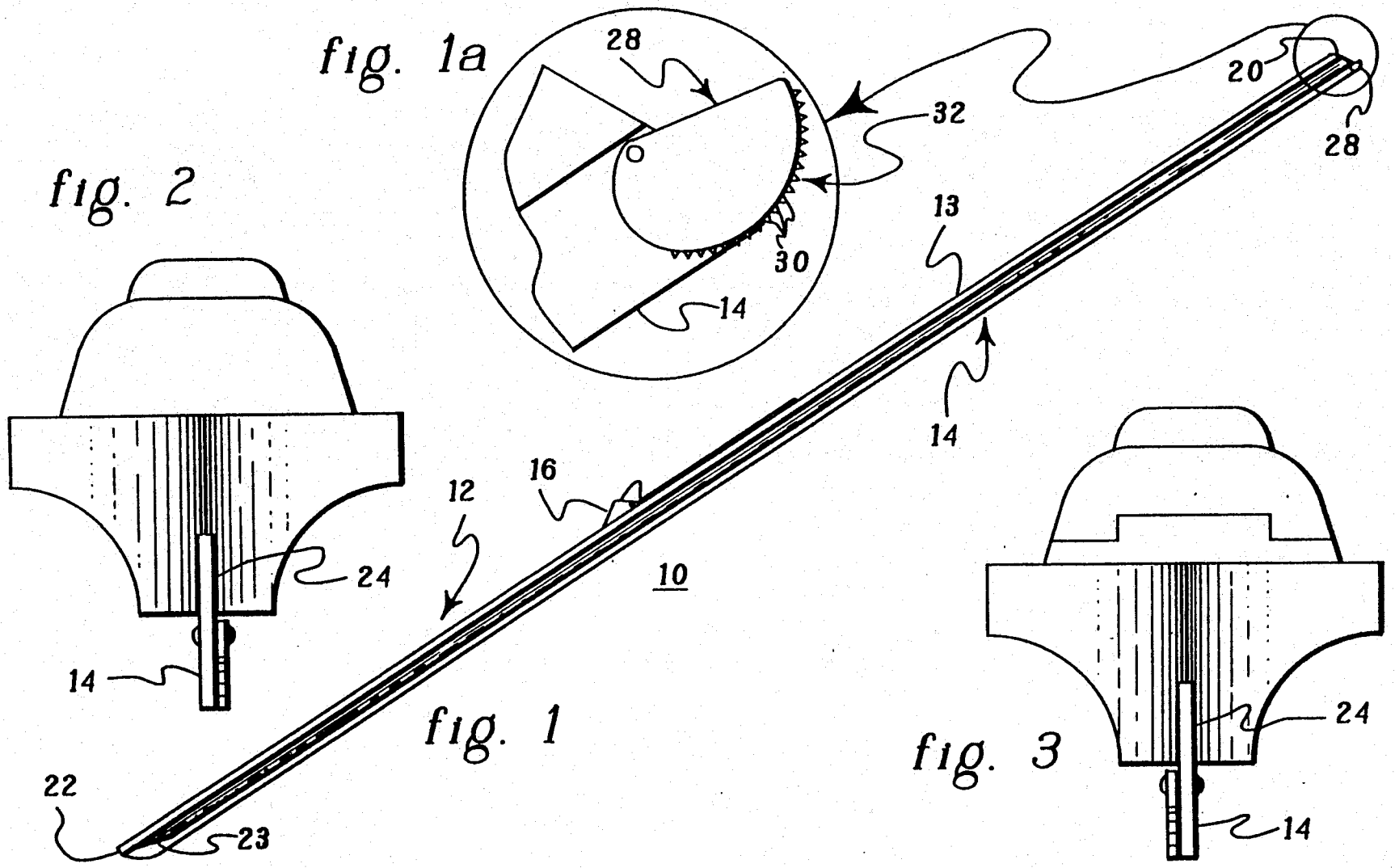
FIG. 1 is an illustration of one embodiment of a wintertime exercise device.
FIG. 1*a* is an exploded view of one embodiment structure secured to the wintertime exercise device.
FIG. 2 is a front view of the wintertime exercise device of FIG. 1.
FIG. 3 is a rear view of the wintertime exercise device of FIG. 1.

One specific embodiment of the present invention is depicted in FIG. 1. The wintertime exercise device generally denoted (10) includes a board-like member (12) and a runner (14).

Board-like member (12), e.g. made of ash, is preferably at least three to four feet long. Member (12) has a top surface (13), a bottom surface (23), a front end (22) and a rear end (20). The tips of front end (22) and rear end (20) come to a point (see FIG. 5). The underside of front end (22) of board-like member (12) is curved inward (see FIG. 2) in order to facilitate the member's riding over bumps and ridges in the ice. The underside of the rear end (20) (see FIG. 3) is also curved inward.

Figures 4, 5:
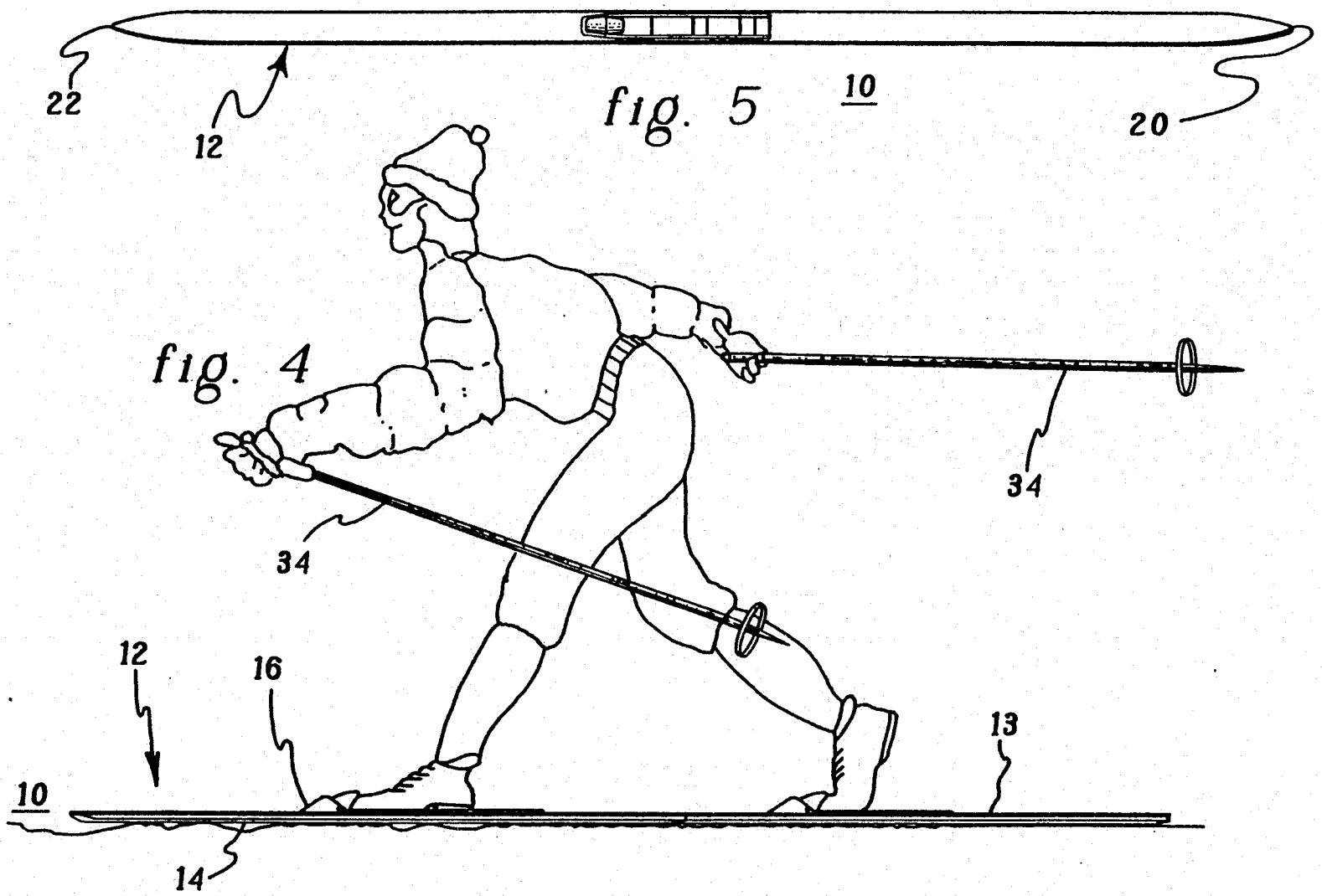
FIG. 4 is a perspective view of a pair of wintertime exercise devices in use in accordance with the present invention.
FIG. 5 is a top view of one embodiment of the present invention.

Top surface (13) is substantially smooth and flat (see FIG. 5). It may be equipped with a binding (16) which is similar in construction to a cross-country racing ski binding. Binding (16) functions to secure a user's foot to top surface (13) of board-like member (12).

Bottom surface (23) of board-like member (12) contains a groove (24) (see FIGS. 2 and 3). Groove (24) is, for example, one-half inch deep and runs substantially the length of board-like member (12). As seen in FIGS. 2 and 3, groove (24) enables runner (14) to be received. Runner (14) may be secured in groove (24) by any conventional means, such as glue. It extends about one-half inch below member (12).

Runner (14), preferably made of stainless steel, is, for example, 1/16 inch thick, one inch wide and extends lengthwise substantially from rear end (20) to front end (22) of board-like member (12). Runner (14) is preferably rockered to a radius of about sixty meters and is sharpened flat except within three inches of each end of runner (14). The three inches on either end of runner (14) are dulled so that the ends do not dig into the ice when the device is first contacting or leaving the frozen surface. It facilitates the user in gliding over the rough or smooth icy terrain.

As shown particularly in the exploded view of FIG. 1*a*, exercise device (10) of the present invention may optionally include an anti-backsliding structure (28). Anti-backsliding structure (28) includes a curved segment (32). Curved segment (32) has a jagged edge and in the embodiment depicted, uniformly spaced teeth (30) which are used to dig into the ice when device (10) is forced to slide backwards. When device (10) is propelled forward, then anti-backsliding structure (28) merely moves along the ice causing very little friction.

Anti-backsliding structure (28) is pivotally secured to runner (14). It may be secured by any conventional means, such as with a screw. Anti-backsliding structure (28) is also preferably readily detachable from runner (14) in order to give a user the opportunity to remove it.

In operation, exercise device (10) is typically used in a manner similar to the use of cross-country racing skis on snow. As shown in FIG. 4, the user wears cross-country ski-type boots on each foot and then secures each foot within a binding (16). The user also preferably utilizes two cross-country skiing-type poles (34) in order to supply some of the thrust necessary to propell across the frozen surface and to maintain balance. These poles are manufactured of a conventional material, such as fiberglass with tungsten carbide tips.

Unlike known cross-country skis, the present wintertime exercise device is particularly suited for rough, icy surfaces. Device (10) is equipped with a long blade or runner (14) which is attached lengthwise to the bottom surface (23) of board-like member (12 (see FIGS. 1 and 4). The length of member (12) and runner (14), preferably three to four feet, prevents the user from using the crossover technique common to hockey, figure or speed skating.

As can be understood from the above description, the present invention provides recreational users, exercisers and competitors with a new type of wintertime activity. Device (10) allows wintertime enthusiasts to participate in a new wintertime activity when the snow is insufficient or of a poor quality or the ice is inadequate or too rough for conventional wintertime activities.

Although a preferred embodiment has been depicted and described in detail herein, it will be apparent to those skilled in the relevant art that various modifications, additions, substitutions and the like can be made without departing from the spirit of the invention, and these are therefore considered to be within the scope of the invention as defined in the appended claims.

What is claimed is:

1. An exercise device for simulating free style cross-country skiing when used on ice, said device adapted to be used in combination with a cross country-type ski binding, said device comprising:

(a) an elongated board-like member having a top surface for attachment of said binding thereto and a bottom surface; and (b) a thin, runner blade mounted lengthwise to the bottom surface of said board-like member, said runner blade having a front end section, a central section, and a rear end section, said runner blade having substantially parallel sides and a flat ice engaging lower surface, said runner blade having a length of at least thirty inches, said runner blade having edges formed by the intersection of said sides and said lower surface to form laterally opposed ice-contacting edges, said edges being sharpened along said central section and said edges being dulled along said front and rear end sections, and said runner blade being rockered to a radius of at least sixty meters, wherein said runner blade protrudes below the bottom surface of said board-like member to a depth substantially greater than the thickness of said runner blade so as to permit said device to be used on ice while decreasing resistance of said device in snow and ice up to the depth of said runner.

2. The exercise device of claim 1, wherein said board-like member and said runner are of substantially equal length.

3. The exercise device of claim 1, wherein said bottom surface includes a lengthwise groove for receiving said runner.

4. The exercise device of claim 1, wherein said board-like member and said runner are each greater than thirty-six inches in length.

5. The exercise device of claim 1, wherein said rear end section of said runner blade includes an anti-backsliding structure.

6. The exercise device of claim 5, wherein said anti-backsliding structure comprises an attachment pivotably secured to said runner, said attachment having a jagged edge positioned to engage the frozen surface when said device is moved in a rearward direction.

7. The exercise device of claim 6, wherein said jagged edge has a substantially uniform surface engaging teeth.

* * * * *